US009551235B2

(12) United States Patent
Khanin et al.

(10) Patent No.: US 9,551,235 B2
(45) Date of Patent: Jan. 24, 2017

(54) AXIAL-FLOW MACHINE

(71) Applicant: ALSTOM Technology Ltd, Baden (CH)

(72) Inventors: Alexander Anatolievich Khanin, Moscow (RU); Andrei Vladimirovich Pipopulo, Moscow (RU)

(73) Assignee: General Electric Company, Schenectady, NY (US)

( * ) Notice: Subject to any disclaimer, the term of this patent is extended or adjusted under 35 U.S.C. 154(b) by 770 days.

(21) Appl. No.: 13/912,383

(22) Filed: Jun. 7, 2013

(65) Prior Publication Data

US 2013/0272849 A1 Oct. 17, 2013

(51) Int. Cl.

| | |
|---|---|
| ***F01D 25/00*** | (2006.01) |
| ***F01D 5/08*** | (2006.01) |
| ***F01D 11/00*** | (2006.01) |
| ***F01D 5/32*** | (2006.01) |

(52) U.S. Cl.

CPC ..... *F01D 25/00* (2013.01); *F01D 5/081* (2013.01); *F01D 5/323* (2013.01); *F01D 11/008* (2013.01)

(58) Field of Classification Search

CPC ..... F01D 5/081; F01D 5/082; F01D 5/084; F01D 5/085; F01D 5/087; F01D 5/088; F01D 5/323; F01D 11/006; F01D 11/008

See application file for complete search history.

(56) References Cited

U.S. PATENT DOCUMENTS

| | | | | |
|---|---|---|---|---|
| 4,557,412 | A | 12/1985 | Lillibridge et al. | |
| 5,865,600 | A | 2/1999 | Mori et al. | |
| 6,273,683 | B1 * | 8/2001 | Zagar | F01D 5/22 277/421 |
| 6,561,764 | B1 * | 5/2003 | Tiemann | F01D 11/006 416/193 A |
| 2005/0129525 | A1 | 6/2005 | Bekrenev et al. | |

FOREIGN PATENT DOCUMENTS

| | | |
|---|---|---|
| CH | 698921 | 12/2009 |
| DE | 10346384 | 4/2005 |
| DE | 102004016174 A1 | 10/2005 |
| EP | 1914386 A1 | 4/2008 |
| EP | 2053285 | 4/2009 |
| GB | 2015658 | 9/1979 |
| RU | 2160367 C2 | 12/2000 |

* cited by examiner

*Primary Examiner* — Richard Edgar
*Assistant Examiner* — Brian P Wolcott
(74) *Attorney, Agent, or Firm* — Ernest G. Cusick; Frank A. Landgraff

(57) ABSTRACT

The invention relates to an axial flow machine, in particular a gas turbine with axial hot gas flow. Gaps between rotor-side heat shields are blocked by easily mountable sealing strips, which are arranged with their longitudinal edges in opposing grooves in the side walls of the respective gap.

7 Claims, 3 Drawing Sheets

AXIAL-FLOW MACHINE

TECHNICAL FIELD

The invention relates to an axial-flow machine, in particular a gas turbine with axial gas flow or an axial compressor.

BACKGROUND

The efficiency of a continuous flow machine, which is achievable, increases with the permissible temperature of the gas flow. Therefore very high temperatures are desirable. In this context, it is usual that the casing and/or the rotor shaft of the continuous flow machine are shielded from the hot gas flow by heat shield segments. These heat shield segments cover cavities, which communicate with one another and with a cooling air source, so that also at very high gas flow temperatures an effective protection of temperature sensitive components can be achieved.

The heat shield segments on the rotor side can be formed, on the one hand, as part of the base of the rotor blades on the side of the rotor. On the other hand, heat shield segments can also be provided between axially neighboring rotor blade rows, separate from the rotor blade bases.

Between adjacent heat shield segments in the circumferential direction there are inevitably gaps, which extend transverse to the circumferential direction of the rotor shaft each side of a parting plane, which forms the gap center. These gaps can cause a more or less pronounced leak of the cooling air, which flows through the above-mentioned cavities.

SUMMARY

The invention addresses the problem of ensuring an effective sealing of the above-mentioned gaps.

In doing so, it should be ensured on the one hand that no cooling air can enter into the gas flow of the continuous flow machine, and on the other hand that no hot gases can flow through the above-mentioned gaps into the cooling air flow.

This problem is solved according to the invention, in that the respective gap is sealed with flat strip-like sealing strips, which are arranged with their longitudinal edges in opposing grooves in the side faces of the heat shield segments, which are facing the parting plane.

A first sealing strip can be arranged accordingly along edges of the side faces of the gap extending parallel to a rotational axis. A further sealing strip can be provided on edges of the side faces, which extend radially with respect to the rotor shaft, so that no cooling air can escape here in the axial direction.

In this way, the gap is sealed against air or gas flows radial or parallel to the rotor axis.

The sealing in the axial direction is particularly desired in the region of the free end faces of the heat shields pointing in the direction of the axial gas flow in the last rotor stage in the direction of flow.

In order to simplify the assembly of the sealing strips which seal the gap in the axial direction, the grooves which receive the sealing strips at the side face of the heat shield adjacent the gap can be accessible from the end face facing the direction of flow, so that the sealing strip can be pushed into the grooves from the said end face. In order to facilitate the assembly, the above mentioned sealing strip can have a recess on its side which faces the direction of flow, into which a flat tool can be inserted which is inserted into the gap, in order to push the sealing strip into the corresponding grooves in the side faces.

The end position of the further sealing strip is preferably formed by providing the grooves, on the side faces of the gap which receive the longitudinal edges of the sealing strip, with a corresponding limited length, whereby the ends of the grooves function as end stops for the sealing strip. According to an especially preferred embodiment the further sealing strip can be secured in its end position by a locking device of the rotary slide valve type, which serves furthermore to fix the heat shield segments adjacent the gap to the rotor shaft, or to fix the rotor blades, connected to the heat shield segments, to the rotor shaft.

Preferred features of the invention can be found in the claims and the following description of the drawings, and will be described in more detail using particularly preferred embodiments the invention.

Protection is sought not only for the combination of features given or shown, but in principle also for any combination of the individual features given or shown.

DETAILED DESCRIPTION

Figure 1:
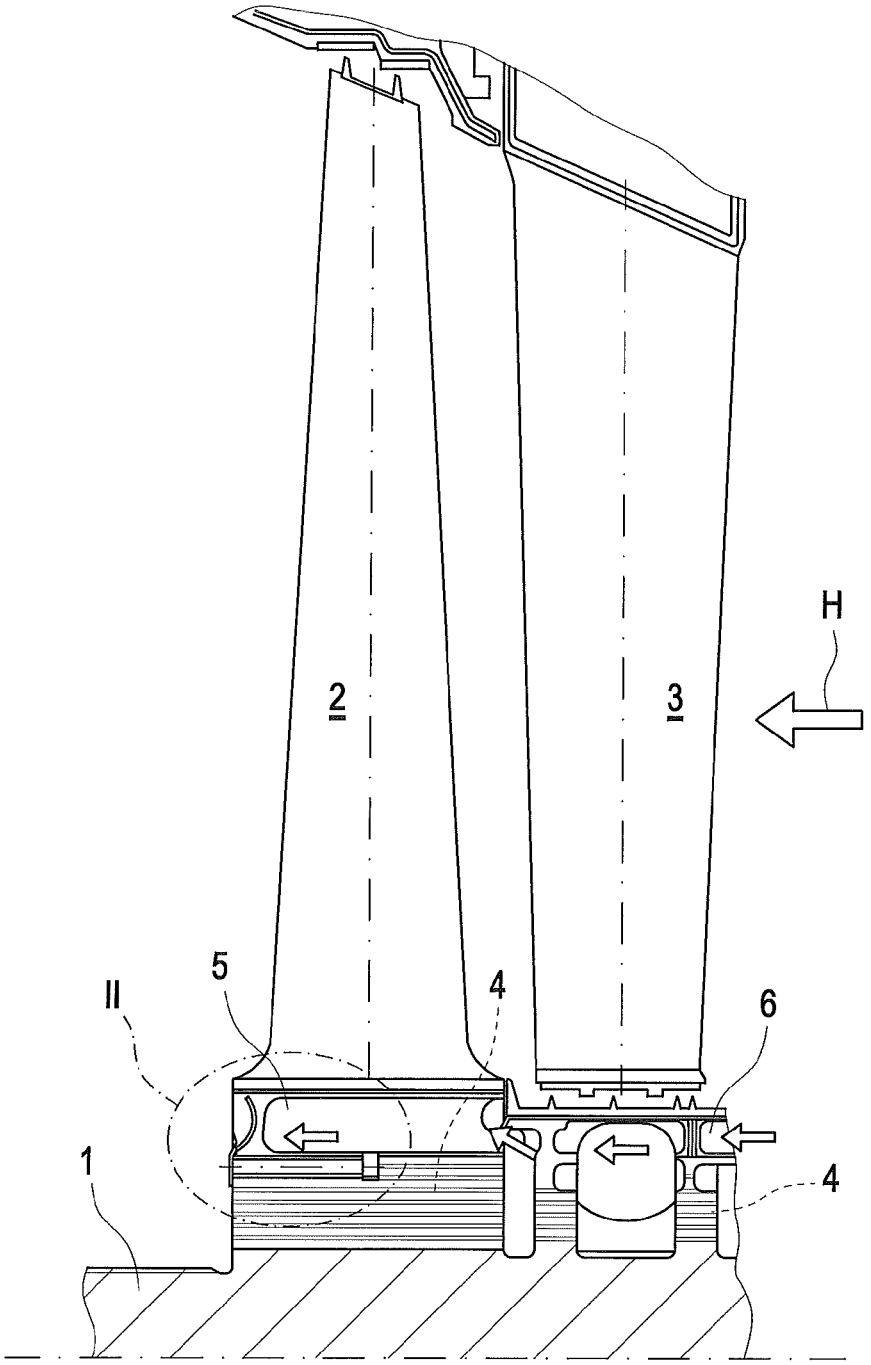
FIG. 1 is a partial axial section in the axial flow direction of a final rotor stage of an axial flow gas turbine.
Figure 2:
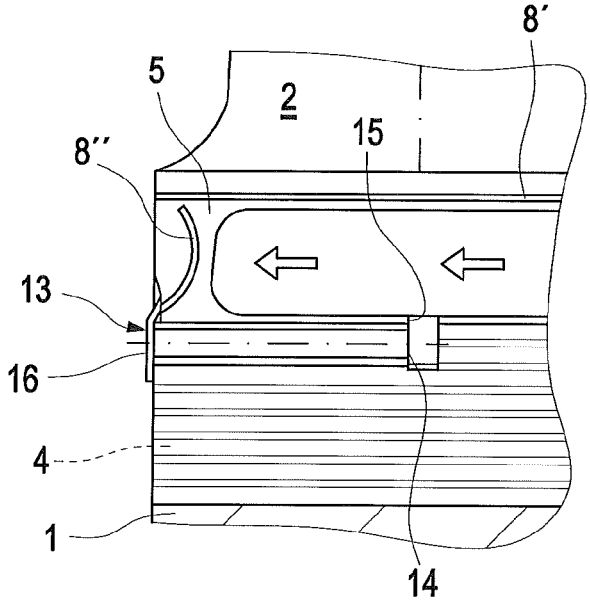
FIG. 2 is an enlarged view of the portion II in FIG. 1.

According to FIG. 1 rotor-side rotor blades 2 are arranged on an only partially shown rotor shaft 1, they are particularly arranged axially behind guide vanes 3 in the direction of flow H of the hot gas flow through the turbine, the guide vanes 3 being arranged stationary relative to the casing. According to FIG. 3, roots 4 are provided at the base of the rotor blades 2 for fixing the rotor blades 2 to the rotor shaft 1, the roots 4 having a fir tree-type cross section in axial view of the rotor shaft 1 and are axially insertable into axial channels formed in the rotor shaft 1. The flanks of the axial channels are provided with undercuts, which complement the fir tree profile of the root 4, so that the respective root 4 and the associated rotor blade 2 are positively retained in the radial direction of the rotor shaft 1.

The bases of the rotor blades 2 are formed as heat shield segments 5 of the rotor shaft between the respective rotor blade 2 and its root 4. That is, they form together a shielding of the rotor shaft 1 from the hot gas flow H. For this purpose the heat shield segments 5 are provided with cavities, which communicate with one another and with a source of cooling air (not shown), so that a cooling air layer forms radially between the hot gas side of the surface of the heat shield segments 5 and the rotor shaft 1. The heat shield segments 5 which are combined with the rotor blades 2 can extend in the axial direction of the rotor shaft 1 into the region of the guide vanes 3. Alternatively, it is also possible to arrange separate heat shield segments 6 in the region of the guide vanes 3, which can have roots 4 similar to the rotor blades 2, and can thus be attached to the rotor shaft 1 in a similar way to the rotor blades 2.

The cavities in the heat shield segments 5 or 6 through which cooling air flows communicate respectively with the cavities in adjacent heat shield segments 5 or 6 in the circumferential direction of the rotor shaft.

Compliment

Figure 3:
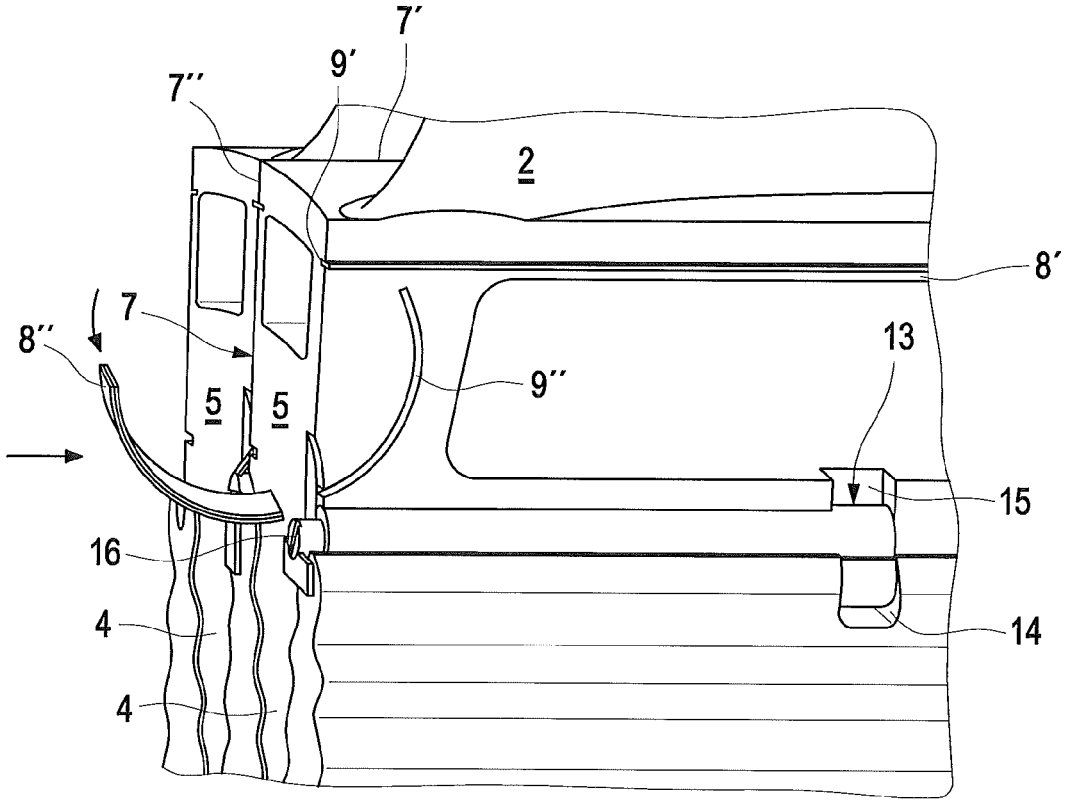
FIG. 3 is a perspective view of two circumferentially adjacent heat shields, in relation to the rotor shaft, at the base of two rotor blades.

As can be seen especially in FIG. 3, adjacent heat shield segments 5 or 6 in the circumferential direction of the rotor shaft 1 are separated from one another by a gap 7, which extends each side of virtual parting plane which forms the gap center, whereby the axis of the rotor shaft lies in the parting plane. The gap 7 comprises, on the one hand, an outward opening 7', which extends substantially parallel to the axis of the rotor shaft, and an opening 7", which extends substantially radially to the axis of the rotor shaft 1.

Because the gap 7 communicates with the cavities in the heat shield segments 5 or 6 provided for cooling air, there is the risk that cooling air can enter the hot gas flow H or that hot gases can escape from the hot gas flow H into the cavities of the heat shield segments 5 or 6 through the gap 7 or through the openings 7' or 7", and therefore get dangerously close to the rotor shaft 1.

This undesired gas or air flow is prevented by sealing the openings 7' or 7" of the gap 7.

Sealing strips 8' are used to seal the openings 7'. The sealing strips 8' are inserted respectively in the longitudinal direction into the grooves 9', which are arranged in the side faces of the heat shield segments 5 or 6 at opposite sides of the parting plane which forms the center of the respective gap 7.

Further sealing strips 8" are arranged in principally the same way in the openings 7". The further sealing strips 8" are curved around an axis, which is perpendicular to the longitudinal axis of the sealing strips. The grooves 9", which receive the further sealing strips are correspondingly curved.

Figure 4:
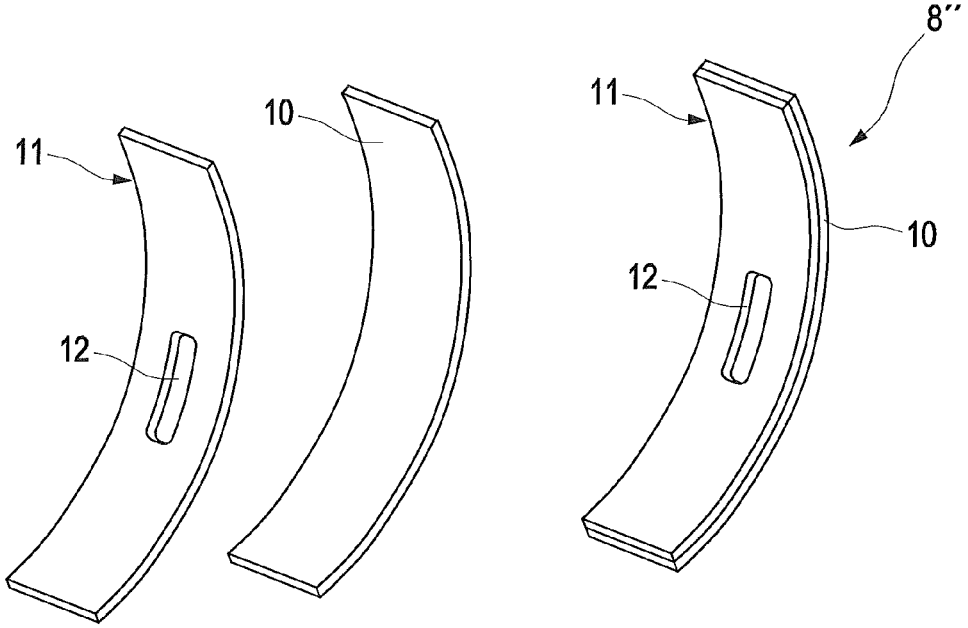
FIG. 4 is a perspective view of a sealing strip and its constituent parts for axially sealing a gap.

According to FIG. 4 the further sealing strips 8" preferably comprise a two-layer construction, whereby a metal strip 10 is welded with a further metal strip 11 to form a double layer. This further metal strip 11 has a slot 12, such that a recess is formed in the double layer sealing strip 8", with which a corresponding tool can engage. With an appropriately flat tool it is therefore possible to reach the recess formed by the slot 12 through the gap 7 and to move the sealing strip 8" into the respective groove 9". This is particularly useful or even essential if the sealing strip 8" needs to be removed.

The length of the grooves 9" which receive the sealing strip 8" are arranged such that the sealing strip 8' has a desired end position. This means that the upper end of the groove 9" in FIG. 3 functions as a stop for the corresponding end of the sealing strip 8". When the rotor shaft 1 rotates quickly, in operation of the continuous flow machine, and there are correspondingly large centrifugal forces, the sealing strip 8" will be held spaced from the sealing strip 8' by the above mentioned stops, so that damage to the sealing strip 8' caused by the sealing strip 8" and the centrifugal forces thereon can be prevented. The distance between the two sealing strips 8' and 8" is so small, that practically no cooling air can flow through it.

As can be seen in FIG. 3, the roots 4 of the rotor blades 2 of the first and last rotor stage in the flow direction of the hot gases H can be axially fixed with the aid of a key-type rotary sliding member 13 inside of the axial channels which receive the roots. In FIG. 3 the (front) rotary sliding member 13 is in the unlocked rotary position. In this position, a lock arm is received in a recess 14 of the rotor shaft 1, such that the root 4 can be axially moved in the rotor shaft 1. If the rotary sliding member 13 is rotated about 180°, the rotary sliding member 13 engages the recess 14 of the rotor shaft 1 as well as a recess 15 in the root 4 or in a heat shield segment 5 belonging to the root, such that the root 4 and its heat shield segment 5 are locked in the axial direction of the rotor shaft 1. At the same time an operating handle 16 of the rotary sliding member 13 rotates into a position which covers the open ends of the grooves 9", whereby in this position the operating handle 16 locks resiliently (bending by hammer) into a recess in an end face between adjacent heat shield segments 5. In the locking position of the rotary sliding member 13 the sealing strip 8" is therefore also secured in the desired position Before the assembly of the heat shield segments or of their roots 4 to the rotor shaft, the rotary sliding member 13 can be put in a recess in the rotor shaft in its unlocked position.

What is claimed is:

1. An axial flow machine, comprising:

rotor-side rotor blades wherein each rotor-side rotor blade comprises a root and a base;

stator-side guide vanes, wherein the rotor blades are secured to a rotor shaft, the roots positively engaging in correspondingly undercut axial channels in a rotor shaft, wherein the bases are formed as heat shields of the rotor shaft and have cavities which communicate with one another and with a source of cooling air, and wherein there is a gap between adjacent bases of adjacent rotor blades in a circumferential direction of the rotor shaft, the gap communicating with the cavities wherein the gap extends between the bases transversely to the circumferential direction on each side of a parting plane which forms a center of the gap, wherein the gap is sealed on a gas flow side by flat-strip type sealing strips, which are arranged with their longitudinal edges in opposing grooves in side faces of the bases which are facing the parting plane; and a further sealing strip arranged at at least one end face of the adjacent bases at edges of the side faces of the bases which extend in a radial direction of the rotor shaft, wherein the further sealing strip is curved about an axis perpendicular to a longitudinal plane of the sealing strip and is arranged in a corresponding curved groove in the side faces of the bases.

2. An axial flow machine according to claim 1, comprising:

a first sealing strip arranged at the edges of the side faces on the gas flow side extending in the axial direction of the rotor shaft.

3. An axial flow machine according to claim 1, wherein the further sealing strip is arranged in the at least one end face of the bases facing the flow direction (H).

4. An axial flow machine according to claim 1, wherein the curved grooves are, at their radially inner ends in relation to the rotor axis, open to an adjacent end face of the bases.

5. An axial flow machine according to one of claim 1, wherein a recess is provided in the further sealing strip in the region of the parting plane of the gap for a flat tool which can be inserted into the gap, the sealing strip being displaceable longitudinally in the respective grooves by the tool.

6. An axial flow machine according to claim 5, wherein the further sealing strip is composed of two layers whereby a slot is provided in one of the layers for forming the recess.

7. An axial flow machine according to claim 1, comprising:

a rotary sliding member configured to axially lock the root of a rotor blade to the rotor shaft, and cover open radially inner ends of the curved grooves which receive the further sealing strip.

* * * * *